US007594529B2

(12) United States Patent
Jones

(10) Patent No.: US 7,594,529 B2
(45) Date of Patent: Sep. 29, 2009

(54) INVESTMENT CASTING PROCESS

(75) Inventor: Samantha Jones, Bilston (GB)

(73) Assignee: University of the Birmingham, Birmingham (GB)

( * ) Notice: Subject to any disclaimer, the term of this patent is extended or adjusted under 35 U.S.C. 154(b) by 243 days.

(21) Appl. No.: 10/523,855

(22) PCT Filed: Aug. 8, 2003

(86) PCT No.: PCT/GB03/03459

§ 371 (c)(1),
(2), (4) Date: Sep. 30, 2005

(87) PCT Pub. No.: WO2004/014580

PCT Pub. Date: Feb. 19, 2004

(65) Prior Publication Data

US 2006/0108093 A1 May 25, 2006

(30) Foreign Application Priority Data

Aug. 8, 2002 (GB) ..... 0218382

(51) Int. Cl.
*B22C 9/04* (2006.01)

(52) U.S. Cl. ..... 164/35; 164/516

(58) Field of Classification Search ..... 164/34–36, 164/516–519

See application file for complete search history.

(56) References Cited

U.S. PATENT DOCUMENTS 3,616,840 A * 11/1971 Dunlop ..... 164/518
3,754,946 A 8/1973 Moore ..... 106/38.35
3,894,572 A * 7/1975 Moore, Jr. ..... 164/516
4,204,872 A * 5/1980 Hayati et al. ..... 106/38.35

OTHER PUBLICATIONS

Dootz E R et al: "Simplification of the Chrome-Cobalt Partial Denture Casting Procedure" Journal of Proshetic Dentistry, May 1967, p. 465, Line 1—p. 467, Line 3, Tables I,II, Figures 1-3.

* cited by examiner

*Primary Examiner*—Kuang Lin
(74) *Attorney, Agent, or Firm*—Ohlandt, Greeley, Ruggiero & Perle, L.L.P.

(57) ABSTRACT

A method for the production of a shell mould. The method comprises the sequential steps of:

(i) dipping a preformed expendable pattern into a slurry of refractory particles and colloidal liquid binder whereby to form a coating layer on said pattern, (ii) depositing particles of refractory material onto said coating, and (iii) drying, steps (i) to (iii) being repeated as often as required to produce a shell mould having a primary coating layer and at least one secondary coating layer, characterised in that during at least one performance of step (ii) a gel-forming material is also deposited onto the coating layer formed in step (i).

14 Claims, No Drawings

INVESTMENT CASTING PROCESS

FIELD OF THE INVENTION

The present invention relates to an improved investment casting process, and in particular to a process which is much more rapid than conventional processes.

DISCUSSION OF THE BACKGROUND ART

A typical investment casting process involves the production of engineering metal castings using an expendable pattern. The pattern is a complex blend of resin, filler and wax which is injected into a metal die under pressure. Several such patterns, once solidified are assembled into a cluster and mounted onto a wax runner system. The wax assembly is dipped into a refractory slurry consisting of a liquid binder and a refractory powder. After draining, grains of refractory stucco are deposited onto the damp surface to produce the primary refractory coating (the covering of the assembly with refractory material is known as "investing", hence the name for the process). When the primary coat has set (usually by air drying until the binder gels) the assembly is repeatedly dipped into a slurry and then stuccoed until the required thickness of mould shell is built up. Each coat is thoroughly hardened between dippings, and so each mould can take from between 24 and 72 hours to prepare. The purpose of the stucco is to minimise drying stresses in the coatings by presenting a number of distributed stress concentration centres which reduce the magnitude of any local stresses. Each stucco surface also provides a rough surface for keying in the next coating. The particle size of the stucco is increased as more coats are added to maintain maximum mould permeability and to provide bulk to the mould.

In recent years, advanced ceramics (eg. silicon nitride) components have been developed which offer significant advantages over comparable metal components. Many processes by which such ceramic components can be made are known, and these include machining, injection moulding, slip casting, pressure casting and gelcasting. In gelcasting, a concentrated slurry of ceramic powder in a solution of organic monomer is poured into a mould and polymerised in situ to form a green body in the shape of the mould cavity. After demoulding, the green ceramic body is dried, machined if necessary, pyrolysed to remove binder and then sintered to full density. Aqueous based systems, such as the acrylamide system, have been developed in which water-soluble monomers are used, with water as the solvent.

It is an object of the present invention to provide an improved investment casting process which obviates or mitigates one or more problems associated with known investment casting processes and which preferably significantly reduces the time required for forming a shell mould.

SUMMARY OF THE INVENTION

According to the present invention, there is provided a process for the production of a shell mould, comprising the sequential steps of:

(i) dipping a preformed expendable pattern into a slurry of refractory particles and colloidal liquid binder whereby to form a coating layer on said pattern, (ii) depositing particles of refractory material onto said coating, and (iii) drying, steps (i) to (iii) being repeated as often as required to produce a shell mould having the required number of coating layers, characterised in that during at least one performance of step (ii) particles of a gel-forming material are also deposited onto the coating layer formed in step (i) such that after contact with the coating layer moisture is absorbed by the gel-forming material thereby causing gellation of the colloidal binder so reducing the time required for drying in step (iii).

Preferably, the method also includes the additional step (iv), carried out after the final step (iii) of applying a seal coat comprising a slurry of refractory particles and colloidal liquid binder, followed by drying.

DETAILED DESCRIPTION OF THE PREFERRED EMBODIMENT

In shell mould formation, the coating layer applied to the expendable pattern is usually referred to as the primary coating and subsequent slurry coatings are referred to as secondary coatings. Typically, three to twelve secondary coatings are applied.

Preferably, the gel-forming material is applied onto each secondary coating (i.e. during each repetition of step (ii) after the first). More preferably, the gel-forming material is applied onto the primary coating.

It will be understood that the deposition of refractory particles and gel-forming material in step (ii) may be achieved by any convenient method, such as by use of a rainfall sander or a fluidised bed. The refractory particles and gel-forming material may be applied independently and/or sequentially or preferably they may be premixed. In a particularly preferred embodiment the refractory particles are pre-coated with the gel-forming material.

Preferably, the amount of gel-forming material used in step (ii) is no more than 100% by weight, more preferably no more than 5%, even more preferably no more than 3% and most preferably no more than 2 wt % of the refractory material particles used in that step (ii).

Preferably, said gel-forming material is a polymer, more preferably a super absorbent polymer exemplified by polyacrylamide and polyacrylate.

In general, at least 50 wt % (and even more preferably at least 80 wt %) of the gel-forming material particles (in those embodiments in which the gel-forming material does not coat the refractory material particles) are preferably no larger than 1 mm, more preferably no larger than 300 μm and most preferably no larger than 200 μm. In a particularly preferred embodiment, substantially all (i.e. at least 95 wt %) of the polymer particles are no more than 300 μm in size. Although there is no theoretical minimum particle size for the gel-forming material, fine powders can be problematic, particularly when applied by a rainfall sander. Thus, a preferred minimum particle size is 50 μm and more preferably 75 μm. The particles may all be substantially the same size, or there may be a particle size distribution below the maximum size.

Advantageously, the process (apart from the use of the moisture absorbing material and the reduced drying times which result) can be substantially the same as a standard investment casting process using conventional machinery and materials. Thus, it will be understood that the nature of the expendable pattern, the slurry compositions used in step (i) (and step (iv) when present) and the refractory particles used in step (ii) may be any of those known to the person skilled in the art of investment casting.

Moreover, the method preferably includes a step of removing the expendable pattern from the shell mould after the last step (iii) (or step (iv) when present) and more preferably the method includes a final step of firing the resultant shell mould.

Firing may be effected by heating to 950° C. or more. Preferably however, a multi-step firing procedure is adopted. For example, a first step may involve heating to a temperature of from 400 to 700° C. at a heating rate of from 1 to 5° C./min (preferably 1 to 3° C./min), followed by a second step of heating to at least 950° C. (preferably about 1000° C.) at a rate of from 5 to 10° C./min. The temperature may be maintained between the first and second steps for a short period (eg. less than 10 minutes). Heating to at least 950° C. may be effected in three or more steps.

The present invention further resides in a shell mould producible by the method of the present invention.

The present invention will be further described with reference to the following examples.

COMPARATIVE EXAMPLE 1

The comparative example was intended to be representative of a standard shell used for aluminium alloy casting and was constructed as follows:

A filled-wax test piece was dipped into a first slurry (primary) for 30 seconds and drained for 60 seconds. Coarse-grained stucco material was then deposited onto the wet slurry surface by the rain fall sand method (deposition height about 2 m). The coated test piece was placed on a drying carousel and dried for the required time under controlled conditions of low air movement. Extended drying removes moisture from the colloidal binder, forcing gellation of the particles to form a rigid gel. Subsequent coats were applied by dipping (30 seconds) in a second (secondary) slurry followed by draining (60 seconds), with subsequent stucco application (rainfall sand method, deposition height about 2 m) and drying for the required time after each stucco application. In total, four secondary coatings were applied. Finally, a seal coat was applied (dip in secondary slurry, but no stucco application), followed by drying.

The primary and secondary slurry specifications are contained in Table 1, with the other various process parameters being given in Table 2. The latex addition in Table 1 relates to the use of a water-based latex system, which is added to the base binder to improve unfired strength.

TABLE 1

Slurry specifications for aluminium shell preparation (all figures are wt %)

| Slurry | binder silica content (wt %) | latex polymer addition (wt %) | filler type | refractory loading (wt % of total slurry) |
|---|---|---|---|---|
| Primary | 26 | 6 | (a) 200 mesh zircon (b) 200 mesh fused silica | 77% a:b 3:1 |
| Secondary | 22 | 8 | 200 mesh fused silica | 57% |

TABLE 2

Shell build specifications for comparative example

| Coating | Stucco | Drying air speed ($ms^{-1}$) | Drying time (mins) |
|---|---|---|---|
| primary | 50/80 mesh alumino-silicate | 0.4 | 1440 |
| secondary 1 | 30/80 mesh alumino-silicate | 3 | 90 |

TABLE 2-continued

Shell build specifications for comparative example

| Coating | Stucco | Drying air speed ($ms^{-1}$) | Drying time (mins) |
|---|---|---|---|
| secondary 2 | 30/80 mesh alumino-silicate | 3 | 90 |
| secondary 3 | 30/80 mesh alumino-silicate | 3 | 90 |
| secondary 4 | 30/80 mesh alumino-silicate | 3 | 90 |
| seal coat | none | 3 | 1440 |
| | | Total | 3240 |

EXAMPLE 1

The shell mould according to Example 1 was made in the same manner as for comparative example 1 using the slurries of Table 1, except that the stucco applied onto the secondary coatings included particles of polyacrylamide (at a loading of 1 part polyacrylamide to 10 parts stucco. The process parameters are given in Table 3. When the polyacrylamide is deposited onto the wet slurry surface, it rapidly absorbs moisture from the adjacent colloidal portion of the slurry forcing gellation to a rigid gel without the necessity of extended drying times.

It is anticipated that drying times can be reduced even further by the inclusion of polyacrylamide polymer in the stucco applied to the primary slurry coating.

TABLE 3

Shell build specifications for Example 1

| Coating | Stucco | Drying air speed ($ms^{-1}$) | Drying time (mins) |
|---|---|---|---|
| primary | 50/80 mesh alumino-silicate | 0.4 | 1240 |
| secondary 1 | 30/80 mesh alumino-silicate-polyacrylamide* (10:1) | 3 | 10 |
| secondary 2 | 30/80 mesh alumino-silicate-polyacrylamide* (10:1) | 3 | 10 |
| secondary 3 | 30/80 mesh alumino-silicate-polyacrylamide* (10:1) | 3 | 10 |
| secondary 4 | 30/80 mesh alumino-silicate-polyacrylamide* (10:1) | 3 | 10 |
| seal coat | none | 3 | 10 |
| | | Total | 1490 |

*particle size 86 wt % > 1 mm, 500 μm ≦ 14 wt % ≦ 1 mm

The shell mould of Example 1 is less dense and uniform in comparison with comparative example 1. The shell of Example 1 is more open and delaminated in places due to swelling of the individual polymer particles during absorbance of moisture from the colloidal binder. The large particle size is disadvantageous in this respect and it is anticipated that these defects will be much reduced by the use of a smaller and much more controlled particle size polyacrylamide addition to the standard stucco sizes.

Shell Thickness Comparisons

Comparisons of the ceramic shell thickness achieved for acrylamide modified (Example 1) and standard (comparative example 1) shell systems can be seen in Table 4. The polyacrylamide increases the shell thickness because the particle size is much larger than the stucco itself. The large size is also represented by the relatively large standard deviation in the data.

TABLE 4 shell thickness comparison

| | status | No. of samples | Average Thickness (mm) | standard deviation (mm) |
|---|---|---|---|---|
| Example 1 | unfired | 5 | 6.81 | 0.92 |
| Comparative Example 1 | unfired | 10 | 4.60 | 0.26 |

Room Temperature Flat Bar Strength Measurement

Strength measurements were carried out in accordance with BS 1902. Injected wax bars were used as the formers for the ceramic shells formed by the procedures indicated above. After formation, the shells were steam Boilerclave™ de-waxed at 8 bar pressure for 4 minutes, followed by a controlled de-pressurisation cycle at 1 bar/minute. Test pieces, approximately 20 mm×80 mm were cut using a grinding wheel and tested in a 3 point bend mode at room temperature (primary coat in compression).

A comparison of the maximum strengths achieved at room temperature in the 3-point bend mode for the shell samples is shown in Table 5. The high dry, green strength of the comparative example 1 shell is a direct result of the latex polymer content, which is reflected by the reduction in strength as the sample is fired at 1000° C. and the latex burns out (data not shown). The strength of the Example 1 shell is relatively low, which is a direct result of the delamination and defects introduced by the use of a very large particle size polyacrylamide. It is anticipated that by the use of a smaller polymer particle size, the swelling of the acrylamide polymer should be reduced to a level which would be more acceptable for investment casting.

TABLE 5 flat bar fracture strength

| Sample | test piece | status | fracture strength |
|---|---|---|---|
| Comparative Example 1 | flat bar | green, dry | 7.8 +/− 0.7 |
| Example 1 | flat bar | green, dry | 2.2 +/− 0.9 |

EXAMPLE 2

In order to address the above-mentioned problems, a further example was prepared, the key differences with Example 1 being:

(i) a smaller particle size of more absorbent polymer was employed, (ii) a smaller amount of polymer was used, and (ii) polymer was incorporated into the primary stucco coating.

The shell build specifications are given in Table 6 below. The slurries were as shown in Table 1.

TABLE 6

Shell build specifications for Example 2

| Coating | Stucco | Drying air speed ($ms^{-1}$) | Drying time (mins) |
|---|---|---|---|
| primary | 50/80 mesh alumino-silicate Liquiblock 144 (2.5 wt %)* | 1.8 | 10 |
| secondary 1 | 30/80 mesh alumino-silicate Liquiblock 144 (2.5 wt %)* | 3 | 10 |
| secondary 2 | 30/80 mesh alumino-silicate Liquiblock 144 (2.5 wt %)* | 3 | 10 |
| secondary 3 | 30/80 mesh alumino-silicate Liquiblock 144 (2.5 wt %)* | 3 | 10 |
| secondary 4 | 30/80 mesh alumino-silicate Liquiblock 144 (2.5 wt %)* | 3 | 10 |
| seal coat | none | 3 | 10 |
| | | Total | 60 |

*polyacrylamide having particle size <300 μm

The green dry strength for Example 2 was measured as 2.83+/−0.63 MPa. This was obtained using a different rain sand system than for Example 1, the sand being deposited from a lower height (approximately 10 cm) which is known to reduce strength values. For comparison, comparative example 1 was repeated (referred to hereinafter as comparative example 2) and found to have a green dry strength of 4.86+/−0.54 MPa. Thus, it has been found that in less than 2% of the time required to produce a standard shell mould, the method of the present invention allows the production of a mould having nearly 60% of the strength, which is, as will be shown below, sufficient for casting.

In addition to the green dry strength measurements, Example 2 and comparative example 2 were tested for their green wet strength (to simulate strength during de-waxing) and their fired strength under different heating regimes. The results are shown in Table 7 below.

TABLE 7 flat bar fracture strengths for Example 2

| Example | Status | Fracture Strength (MPa) |
|---|---|---|
| Comparative Example 2 | green, dry | 4.86 +/− 0.54 |
| | green, wet | 4.55 +/− 0.47 |
| | Fired (method A) | 4.24 +/− 0.61 |
| | Fired (method B) | 3.80 +/− 0.38 |
| Example 2 | green, dry | 2.83 +/− 0.63 |
| | green, wet | 2.47 +/− 0.43 |
| | Fired (method B) | 2.17 +/− 0.13 |
| | Fired (method C) | 2.03 +/− 0.45 |

Firing method A: to 1000° C. @20 C./min, dwell 60 min, furnace cool

Firing method B: to 700° C. @ 1 C/min, dwell 6 min, to 1000° C. @5 C/min, dwell 30 min, furnace cool Firing method C: to 700° C. @ 2 C/min, dwell 6 min, to 1000° C. @10 C/min, dwell 60 min, furnace cool.

The Example 2 moulds did not crack during de-waxing. Thus, it has been shown that the method of the present invention allows the production of shell moulds, which are sufficiently strong for investment casting, in a fraction of the time required using standard methods.

What is claimed is:

1. A method for the production of a shell mould, comprising:

(i) dipping a preformed expendable pattern into a slurry of refractory particles and colloidal liquid binder whereby to form a coating layer on said pattern, (ii) depositing particles of refractory material onto said coating, and (iii) drying, steps (i) to (iii) being repeated as often as required to produce a shell mould having a primary coating layer and at least one secondary coating layer, wherein during at least one performance of step (ii) a gel-forming material is also deposited onto the coating layer formed in step (i), such that after contact with the coating layer, moisture is absorbed by the gel-forming material thereby causing gelation of the colloidal binder so reducing the time required for drying in step (iii), and wherein the gel-forming material is a super absorbent polymer.

2. The method as claimed in claim 1, wherein the method also includes the additional step (iv), carried out after the final step (iii), of applying a seal coat comprising a slurry of refractory particles and liquid binder, followed by drying.

3. The method as claimed in claim 1, wherein the gel-forming material is applied onto each secondary coating.

4. The method as claimed in claim 1, wherein the gel-forming material is applied onto the primary coating layer.

5. The method as claimed in claim 1, wherein the polymer is polyacrylamide or polyacrylate.

6. The method as claimed in claim 1, wherein the polymer is a particulate material and at least 50 wt % of the polymer particles are 300 μm or smaller.

7. The method as claimed in claim 6, wherein at least 95 wt % of the polymer particles are 300 μm or smaller.

8. The method as claimed in claim 1, wherein the refractory particles are coated with gel-forming material.

9. The method as claimed in claim 2, which includes a step of removing the expendable pattern from the shell mould after the last step (iii) or step (iv) when present and preferably a final step of firing the resultant shell mould.

10. The method as claimed in claim 9, wherein firing is effected by heating to a temperature of from 400° C. to 700° C. of a heating rate of from 1° C. to 5° C./min, followed by heating to at least 950° C. at a heating rate of 5° C./min or more.

11. The method as claimed in claim 1, wherein the gel-forming material added during each step (ii) constitutes less than 10% by weight of the refractory particles added during that step (ii).

12. The method as claimed in claim 11, wherein the gel-forming material constitutes less than 3 wt % of the refractory particles.

13. The method as claimed in claim 9, further comprising a final step of firing the resultant shell mould.

14. The method as claimed in claim 7, wherein a minimum size of the particles is 50 μm.

* * * * *